US010286724B1

(12) United States Patent
Moore

(10) Patent No.: US 10,286,724 B1
(45) Date of Patent: May 14, 2019

(54) WRITING INSTRUMENT WITH LOCKING CAP

(71) Applicant: Christian John James Moore, Orlando, FL (US)

(72) Inventor: Christian John James Moore, Orlando, FL (US)

( * ) Notice: Subject to any disclaimer, the term of this patent is extended or adjusted under 35 U.S.C. 154(b) by 135 days.

(21) Appl. No.: 15/416,830

(22) Filed: Jan. 26, 2017

Related U.S. Application Data

(60) Provisional application No. 62/287,485, filed on Jan. 27, 2016, provisional application No. 62/341,288, filed on May 25, 2016.

(51) Int. Cl.
*B43K 23/12* (2006.01)

(52) U.S. Cl.
CPC ..... *B43K 23/12* (2013.01)

(58) Field of Classification Search
CPC ..... B43K 23/12; B43K 23/128; B23K 24/02; B23K 24/06
See application file for complete search history.

(56) References Cited

U.S. PATENT DOCUMENTS

| | | | | |
|---|---|---|---|---|
| 2,192,644 A | | 3/1940 | La May et al. | |
| 3,931,983 A | | 1/1976 | Kanoouse et al. | |
| 4,270,664 A | | 6/1981 | Buono | |
| 4,979,840 A | * | 12/1990 | Madaus | B43K 5/10 401/17 |
| 5,336,011 A | | 8/1994 | Ferguson et al. | |
| 5,551,582 A | | 9/1996 | Robinson | |
| 6,626,600 B1 | | 9/2003 | Brand et al. | |
| 6,890,118 B2 | | 5/2005 | Oike | |
| 7,334,694 B2 | | 2/2008 | Suffa | |

(Continued)

FOREIGN PATENT DOCUMENTS

| | | |
|---|---|---|
| CN | 203818808 | 9/2014 |
| CN | 103738077 | 10/2015 |

(Continued)

OTHER PUBLICATIONS

Rao Daoxin, Abstract of CN103738077, obtained at <https://worldwide.espacenet.com/publicationDetails/biblio?II=0&ND=3&adjacent=true&locale=en_EP&FT=D&date=20140423&CC=CN&NR=103738077A&KC=A> on Jan. 3, 2018.

(Continued)

*Primary Examiner* — Jennifer C Chiang
(74) *Attorney, Agent, or Firm* — Hanrahan Law Firm, P.A.; Benjamin M. Hanrahan

(57) ABSTRACT

A child-resistant writing instrument with a cap that lockingly engages a body portion via a locking assembly is presented herein. The locking assembly includes a pair of locking protrusions or pins on the cap that correspondingly fit within locking channels on the body of the writing instrument. A biasing mechanism, such as a spring, is used to bias the cap when locked to the body portion. Specifically, when the locking pins are positioned to enter the locking channel, the cap is pushed against the biasing force of the spring until the locking pins or protrusions enter a lateral or inner groove of the locking channel. The cap is then twisted or rotated such that the locking pins slide within the lateral groove toward a locking notch. The biasing force of the spring will then bias the pins into the locking notch, thereby locking the cap to the body.

8 Claims, 5 Drawing Sheets

(56) References Cited

U.S. PATENT DOCUMENTS

| | | | |
|---|---|---|---|
| 8,282,302 | B2 | 10/2012 | Zahn et al. |
| 8,540,450 | B1 | 9/2013 | Conable |
| 2005/0205607 | A1 | 9/2005 | Hierzer et al. |
| 2012/0187074 | A1 | 7/2012 | Glynn |

FOREIGN PATENT DOCUMENTS

| | | | |
|---|---|---|---|
| CN | 103738079 | 4/2016 | |
| WO | WO 9418013 A2 * | 8/1994 | ..... B43M 11/08 |

OTHER PUBLICATIONS

Rao Daoxin, English Translation of CN103738077, obtained at <https://www.google.com.pg/patents/CN103738077A?cl=en> on Jan. 3, 2018.

Zhang Yujie, Abstract of CN103738079 A, obtained at <https://worldwide.espacenet.com/publicationDetails/biblio?II=0&ND=3&adjacent=true&locale=en_EP&FT=D&date=20140423&CC=CN&NR=103738079A&KC=A> on Jan. 3, 2018.

Zhang Yujie, English Translation of CN103738079 A, obtained at <https://www.google.com/patents/CN103738079A?cl=en&dq=CN103738079+A> on Jan. 3, 2018.

Zhang Yujie, Abstract of CN203818808, obtained at <https://worldwide.espacenet.com/publicationDetails/biblio?II=0&ND=3&adjacent=true&locale=en_EP&FT=D&date=20140910&CC=CN&NR=203818808U&KC=U> on Jan. 3, 2018.

Zhang Yujie, English Translation of CN203818808, obtained at <https://www.google.com/patents/CN203818808U?cl=en&dq=CN203818808> on Jan. 3, 2018.

Amazon.com | "Amazon.com: Crayola 6 Flip Top Markers: Toys & Games" | obtained at <https://www.amazon.com/Crayola-6-Flip-Top-Markers/dp/B001BELVIE/ref=pd_sim_21_1?ie=UTF8&dpID=5141e88Sj3L&dpSrc=sims&p> on Jan. 3, 2018.

Amazon.com | "Amazon.com: BIN5864410—Crayola Twistable Marker: Toys & Games" | obtained at <https://www.amazon.com/gp/product/B000EYF6V0/ref=s9_simh_gw_g21_i3_r?pf rd_m=> on Jan. 3, 2018.

Amazon.com | "Amazon.com : Sharpie Retractable Permanent Markers, Fine Point, Assorted Colors, 12 Count : Office Products" | obtained at <http://www.amazon.com/gp/product/B000EYF6V0/> on Jan. 3, 2018.

* cited by examiner

WRITING INSTRUMENT WITH LOCKING CAP

CLAIM OF PRIORITY/CROSS REFERENCE TO RELATED APPLICATIONS

The present application is based on and a claim of priority is made under 35 U.S.C. § 119(e) to provisional patent application Ser. No. 62/287,485, having a filing date of Jan. 27, 2016, the contents of which are incorporated herein their entirety by reference.

The present application is also based on and a further claim of priority is made under 35 U.S.C. § 119(e) to provisional patent application Ser. No. 62/341,288, having a filing date of May 25, 2016, the contents of which are also incorporated herein their entirety by reference.

FIELD OF THE INVENTION

The present invention is generally directed to a child-resistant writing instrument, such as, but not limited to a pen, marker, permanent marker, dry erase marker, dot marker, paint marker, felt tip pen, ball point pen, fountain pen, highlighter, etc., with a cap that can be lockingly engaged to the body portion in order to restrict access to the ink or writing cartridge therein.

BACKGROUND OF THE INVENTION

Markers, pens, and other like writing instruments are found in virtually every home, office and class rooms, including daycares, preschools, public and private schools, etc., yet they can often be extremely harmful to children (e.g., in the form of a choking hazard or ingestion hazard) and can be used, most often by children, to harm or destroy valuables.

For example, the cap of a pen, marker, or other writing instrument can either fall off or be taken off, thereby becoming an extreme choking hazard for children, and particularly children between the ages of 0 and 5. Ingesting the cap, ink or other portion of the pen, marker or writing instrument can also be extremely harmful. In addition, children, particularly between the ages of 0 and 5, can often destroy valuables, such as walls, paintings, furniture, etc. by writing on them with access to pens, markers, etc. In the United States, alone, there are over 23 million children between the ages of 0 and 5, and approximately 4 million children born each year. Furthermore, there are about 67,000 elementary schools in the United States where child access to pens, markers and other writing instruments is abundant.

There is thus a need in the art for a writing instrument with a cap that can lock onto the body portion or base in order to restrict access to the cap and/or writing tip (e.g., ink tip) by making it difficult for children of a young age to open. The younger the child, and the less motor skills the child possess, the more likely it is that the child or individual would not be able to remove or unlock the cap of the proposed writing instrument.

The proposed writing instrument with locking cap would help reduce the chances of young children choking on or ingesting the cap(s) since the cap will be locked onto the base or body portion of the writing instrument. In some embodiments, the cap can also be locked onto the bottom end or base of the body portion (e.g., when the writing instrument is in use), further preventing access to the cap, alone. In addition, the locked cap would help prevent or reduce the number of children from writing on, and thereby destroying valuables, such as walls, paintings, pictures, furniture, carpet, countertops, clothing, etc.

SUMMARY OF THE INVENTION

The various embodiments of the present invention are directed to a writing instrument with a locking cap, e.g., a cap that lockingly engages with the body portion of the writing instrument in order to restrict inadvertent or unwanted removal thereof. In this manner, the writing instrument may be considered "child-resistant" in that many children, particularly young children between the ages of 0 and 5, will not be able to or will have great difficulty in removing the cap from the body portion of the writing instrument. The writing instrument of the various embodiments of the present invention disclosed herein can include virtually any instrument structured to write, such as, but not limited to a pen, marker, permanent marker, dry erase marker, dot marker, paint marker, felt tip pen, ball point pen, fountain pen, highlighter, etc.

For example, at least one embodiment includes a locking assembly that is adapted and disposed to lockingly engage the cap to the body portion of the writing instrument. Specifically, one embodiment may include a pair of locking protrusions extending from a portion of the cap, e.g., a collar, and a pair or corresponding locking channels disposed on the base or body portion of the writing instrument. A biasing mechanism, such as a coil spring, may be used to bias the cap into the locked engagement, for example, by pushing the cap, and in particular, the locking pins or locking protrusions, into corresponding locking notches within the channels.

For example, in order to lockingly engage the cap to the body portion, the locking pins or locking protrusions are inserted into the locking channels, and the cap is pushed against the biasing force of the spring. This will cause the locking pins or protrusions to enter an inner or intermediate groove where the cap can be twisted or rotated relative to the position of the body portion. At the end of the inner or intermediate groove is a locking notch extending in the direction of the biasing force of the spring such that the spring will bias the locking pins or protrusions into the locking notches. This will lock the cap in place, meaning that attempts to pull the cap off or twist the cap without first pushing against the biasing force will not allow the cap to be removed.

Instead, in order to remove the cap from the body portion, the cap must first be pushed against the force of the biasing mechanism or spring in order to allow the locking pins or protrusions to exit the locking notches and enter the intermediate or inner groove of the locking channels. Then, the cap can be twisted or rotated (in the opposite direction than it was rotated to lock) until the pins or protrusions reach the opening groove or opening of the locking channel. The biasing force from the spring can assist in the removal of the cap from the locking channel and therefore removal of the cap from the body portion.

Some alternative embodiments of the locking assembly can include, for example, a childproof casing that locks around the writing instrument; a device that locks and opens with a similar push-down, twist-off method; a device that locks and requires a user to push opposite ends of the cap together (e.g., tabs on opposite ends of the cap) to unlock and open; a device where the cap is screwed on and off via cooperative threaded components; a device where the cap attaches (e.g., locks) and detaches (e.g., unlocks) from the body portion via magnets or suction; a device with a buckle-type of lock is used to lock and unlock the cap from the body portion; a device with a retractable string that attaches the cap to the body portion of the writing instrument so that when the cap is unlocked and the writing instrument is open, the cap is still attached to the body portion of the writing instrument via the string, tugging on the cap would tighten the string and retract the cap back onto the base or body portion; etc.

These and other objects, features and advantages of the present invention will become more apparent when the drawings as well as the detailed description are taken into consideration.

BRIEF DESCRIPTION OF THE DRAWINGS

Like reference numerals refer to like parts throughout the several views of the drawings provided herein.

DETAILED DESCRIPTION OF THE INVENTION

Figure 1A:
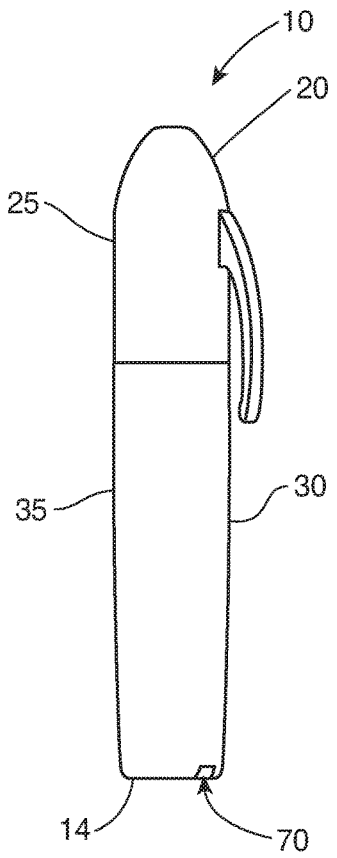
FIG. 1A is a side elevation view of the writing instrument with locking cap as disclosed in accordance with at least one embodiment of the present invention with the cap disposed in a lockingly engaged relation with the body portion.
Figure 1B:
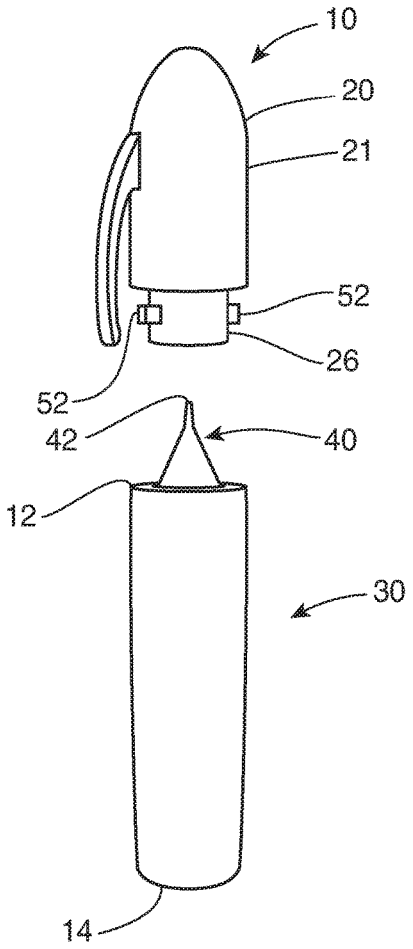
FIG. 1B is a side partially exploded elevation view of the writing instrument with locking cap as disclosed in accordance with at least one embodiment of the present invention with the cap disposed in a removed relation relative to the body portion.

As shown in the accompanying drawings, and with particular reference to FIGS. 1A and 1B, the present invention is directed to a writing instrument, generally referenced as 10, with a locking cap 20, for instance, a cap 20 that lockingly or securely engages with the body portion 30 of the writing instrument 10 in order to restrict inadvertent or unwanted removal thereof (e.g., from a child). In this manner, the writing instrument 10 of certain embodiments can be considered child-resistant in that many children will not be able to or will have great difficulty in removing the cap 20 from the body portion 30 of the writing instrument 10. It should be noted that the writing instrument 10 of the various embodiments of the present invention disclosed herein can include, but is not limited to a pen, marker, permanent marker, dry erase marker, dot marker, paint marker, felt tip pen, ball point pen, fountain pen, highlighter, etc., or virtually any like device structured and adapted to dispense ink or other like substance from an end thereof, and which may, but is not necessarily, meant to be held in an operator's or user's hand.

Specifically, with reference to FIG. 1A, the writing instrument 10, and in particular, the body portion 30 thereof, includes a writing end 12 and a bottom end 14. The bottom end 14, in many instances, is disposed longitudinally opposite from the writing end 12. The writing end 12 is defined as the end in which the ink (or other like substance) is dispensed from the writing instrument 10, for example, via a writing cartridge 40. For instance, the writing cartridge 40 or ink container includes at least one writing tip 42 from which the ink (or other like substance) is dispensed when writing. In many cases, as illustrated in FIG. 1B, for example, the writing tip 42 of the writing cartridge 40 will extend at least partially beyond the writing end 12 of the body portion 30 of the writing instrument 10. It should be noted that other writing cartridges 40 may be used in the full spirit and scope of the present invention, such as, for example, double ended writing cartridges, retractable or 'clicking type' writing cartridges, etc.

Figure 2:
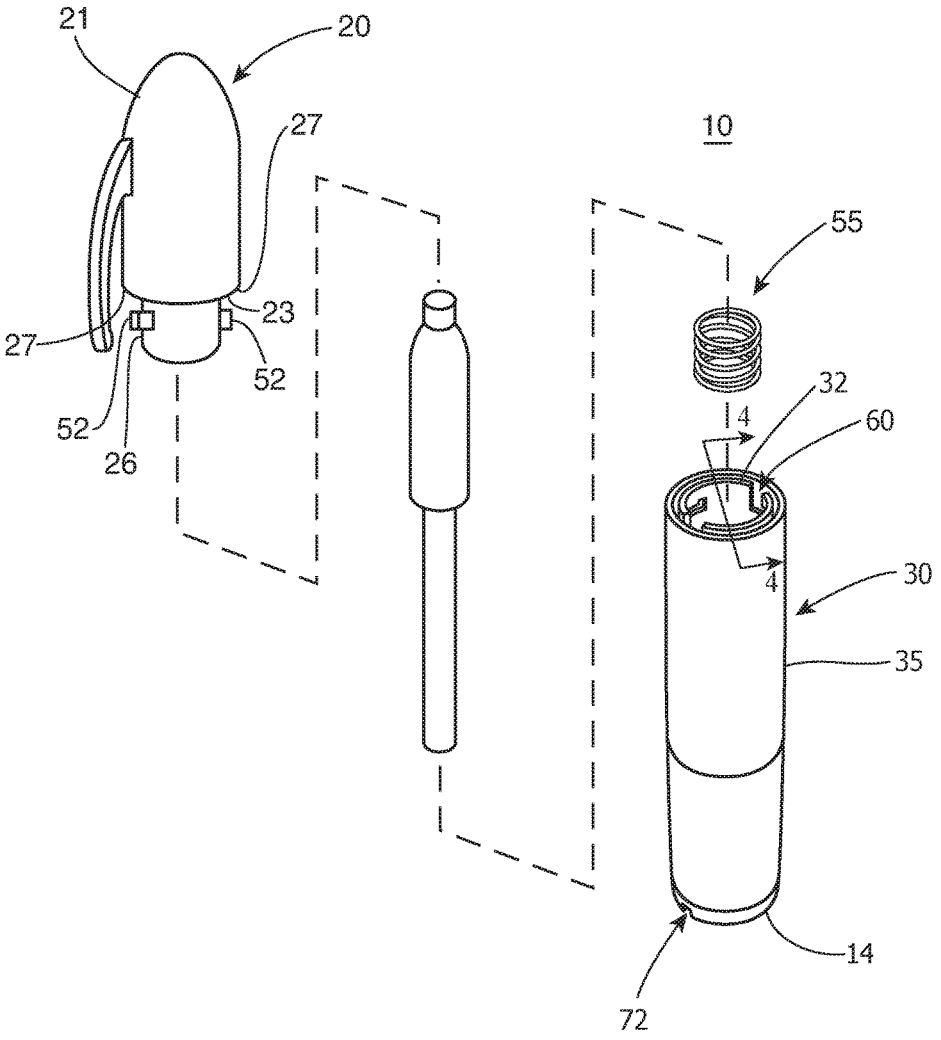
FIG. 2 is an exploded view of the writing instrument with locking cap as disclosed in accordance with at least one embodiment of the present invention.

Moreover, as shown in the exploded view of FIG. 2, the writing cartridge 40 may include a longitudinal, at least partially cylindrical device that is disposed, and in many cases, removably disposed, within an internal at least partially hollow cavity of a receiving portion of the body 30 of the writing instrument 10. The cap 20 can then be secured onto the body portion 30, thereby securing or otherwise restricting access to the writing cartridge 40 contained therein.

Figure 3:
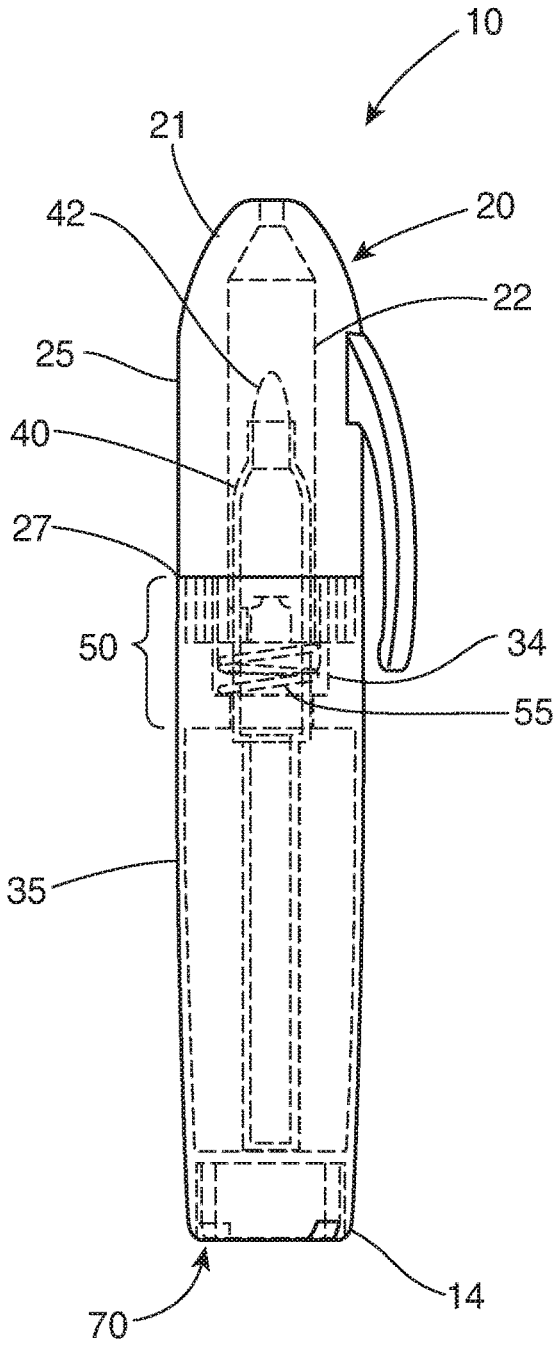
FIG. 3 is side elevation transparent view of the writing instrument with locking cap as disclosed in accordance with at least one embodiment of the present invention.

With reference now to FIG. 3, the cap 20 of at least one embodiment, includes a cap channel 22 adapted to at least partially receive the writing tip 42 of the writing cartridge 40, for example, when the cap 20 is disposed in a connected or locked engagement with the body portion 30, as illustrated. For instance, when the cap 20 is engaged with the body portion 30, the portion of the writing cartridge 40 that extends beyond the writing end 12 of the body portion 30 will be disposed within the cap channel 22. As mentioned above, however, other embodiments may include retractable writing cartridges, or other writing cartridges that may not need to be disposed within a cap channel 22.

In any event, certain embodiments of the present invention are directed to a writing instrument 10 in which the cap 20 may be selectively disposed or positioned between a removed relation from the body portion 30 (e.g., FIG. 1B)(wherein the writing tip 42 of the writing cartridge 40 may be exposed) and a locked engagement (e.g., FIGS. 1A and 3)(wherein the writing tip 42 of the writing cartridge 40 is hidden or access thereto is otherwise restricted).

In this manner, at least one embodiment includes a locking assembly 50 that is adapted and disposed to lockingly engage the cap 20 to the body portion 30 of the writing instrument 10. For instance, while many different locking assemblies 50 structured to secure or lock the cap 20 onto the body portion 30 of the writing instrument 10 are contemplated within the full spirit and scope of the present invention, at least one embodiment includes at least one locking protrusion 52 and at least one cooperatively structured locking channel 60 within which the locking protrusion 52 is disposed and locked. It should be noted that the illustrated embodiment shows a pair of or two locking protrusions 52 and a pair of or two locking channels 60, however, more or less locking protrusions 52 and/or locking channels 60 are contemplated. Furthermore, as illustrated, and with reference to FIGS. 2 and 4, for example, the locking protrusions(s) 52 are disposed on the cap 20, whereas the locking channel(s) 60 are disposed on the body portion 30. However, other embodiments may include the reverse construction, meaning that the locking channel(s) 60 may be disposed on the cap 20 with the locking protrusion(s) 52 disposed on the body portion 30.

Particularly, in the embodiment illustrated, and with reference to FIG. 2, for example, the cap 20 includes a main cap portion 21 and a collar 26, wherein the locking protrusion(s) 52 extend outward, e.g., laterally, from the collar 26. For instance, the collar 26 of at least one embodiment may extend downward from a lower ledge 23 of the main cap portion 21 and the locking protrusion(s) 52 extend substantially outward, e.g., laterally, from the downwardly extended collar 26. As shown, the main cap portion 21 includes an outer wall or outer surface 25 which meets the lower ledge 23 at corner 27. In some embodiments, the collar 26 extends downward below lower ledge 23, and the locking protrusion (s) 52 extend outward from the collar 26, but do not extend beyond the corner 27 where the outer surface 25 of the cap 20 and the lower ledge 23 meet.

Still referring to FIG. 2, the body portion 30 of at least one embodiment includes an outer wall 35 and inner locking wall 32. In at least one embodiment, the locking channel(s) 60 are defined by or otherwise disposed on the inner locking wall 32, and in at least one embodiment, the outer wall 35 is disposed in an at least partially covering, e.g., a circumferentially covering, relation to the inner locking wall 32. In particular, in at least one embodiment, the inner and outer walls 32, 35, respectively, may be concentrically disposed relative to one another, however, they need not be so related in other embodiments.

Figure 4:
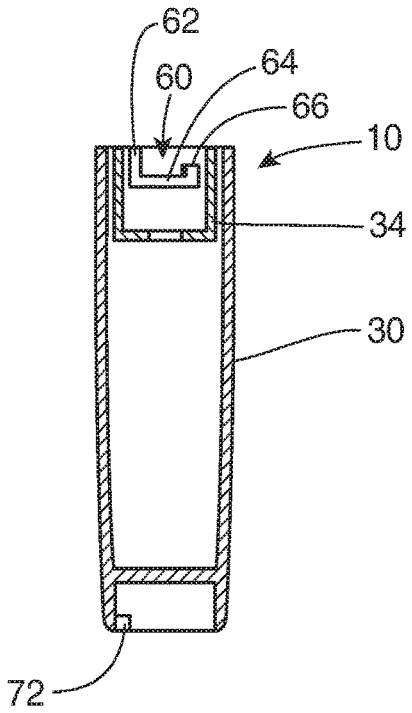
FIG. 4 is a cut-away or sectional view along line 4-4 of FIG. 2.
Figure 6:
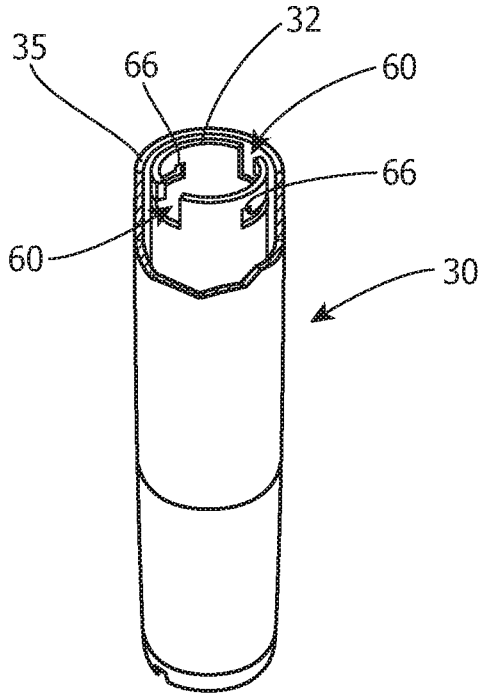
FIG. 6 is a partial cut-away view of the body portion of the writing instrument as disclosed in accordance with at least one embodiment of the present invention.

With reference now to the cut-away or sectional views of FIG. 4 (taken along line 4-4 in FIG. 2) and FIG. 6, at least one of the locking channels 60 of one embodiment is illustrated. Specifically, the locking channel 60 may include an at least partially "U" shaped configuration, as shown. For instance, the locking channel(s) 60 may be structured to include an opening groove, referenced as 62, an inner groove or intermediate groove, referenced as 64, and a locking or end notch, referenced as 66. For instance, the opening groove 62 comprises an open end, for example, at an upper or exposed edge of the inner wall 32, and may extend downward or in a longitudinal direction along the inner wall 32, within which one of the locking protrusions 52 may be positioned or inserted, for example, when locking the cap 20 to the body portion 30 of the writing instrument 10. The locking protrusion 52 can then slide along or within the inner or intermediate groove 64 of the locking channel 60 toward the closed end or locking notch 66. The inner or intermediate groove 64 may extend at least partially or substantially in a lateral direction along the inner wall 32, for example, in an at least partially angular relation (e.g., at least partially perpendicular or orthogonal) to the opening groove 62. Furthermore, the locking notch 66 may extend at least partially or substantially in an upward direction from the end of the inner or intermediate groove 64 or otherwise in a longitudinal manner along the inner wall 32 and at least partially angularly disposed (e.g., at least partially perpendicular or orthogonal) from the inner or intermediate groove 64.

In particular, the locking assembly 50 of at least one embodiment further includes a biasing device referenced as 55, such as a mechanical spring, coil spring, or other like elastic object used to store mechanical energy. The biasing device 55 of at least one embodiment may be disposed within the body portion 30 of the writing instrument 10 proximate the locking channel(s) 60, for example, within a biasing retention portion 34, for engagement with the cap 20. In particular, disposition of the cap 20 into the locking engagement with the body portion 30 will cause the cap 20 to engage the biasing device 55 and, in at least one embodiment, at least partially compress the biasing device 55, causing the biasing device 55 to exert a biasing force upon the cap 20.

For example, in at least one embodiment, a portion of the cap 20, e.g., the collar 26 thereof, may be at least partially disposed within the body portion 20, e.g., within the inner wall 32 thereof, while the locking protrusion(s) 52 are disposed within the locking channel(2) 60, and in particular, the opening groove 62 thereof. Upon doing so, the cap 20, and in particular, the collar 26 thereof, will engage or otherwise at least partially compress the spring or other biasing device 55 seated within the biasing device retention portion 34. The cap 20 will thus be pushed into the body portion 30 against the biasing force of the biasing device 55 as the locking protrusions enter the locking channels 60.

Twisting or rotating of the cap 20 (e.g., in a clockwise rotation in the embodiment of FIG. 2, although other orientations, including a counter-clockwise rotation, are contemplated) will cause the locking protrusions 52 to slide along the inner or intermediate groove 64 of the locking channel 60 and toward the closed end or locking notch 66. When the cap 20 has been twisted or rotated enough such that the locking protrusions 52 reach the end or locking notch 66 of the locking channel 60, the biasing device 55 will cause the cap 20 to be pushed slightly up, or otherwise cause the locking protrusions 52 to be biased into the locking notch 66 of the locking channel 60.

With the biasing device 55 biasing the cap 20 such that the locking protrusions 52 are biased into the locking notches 60 of the locking channels 60, the cap 20 is thereby disposed in the locked engagement with the body portion 20 of the writing instrument 10. In this regard, attempts to rotate the cap 20 in a counter-clockwise direction (in the illustrated embodiment), without first pushing against the biasing force, will not cause the cap 20 to be removed from the body portion 30. This is because the locking protrusions 52 are locked or biased into the locking notches 66 via the biasing device 55.

It should also be noted that in at least one embodiment, with the cap 20 disposed in the locked engagement with the body portion 30 of the writing instrument 10, physical access to the locking assembly 50, and in particular, to the locking protrusions 52, locking channels 60 and biasing device 55, is at least partially restricted from a position external to the writing instrument. For example, with reference to FIGS. 1A and 3, the body portion 30 and the cap 20 cover, either entirely or at least substantially, the locking assembly 50 within the writing instrument 10, such that physical access to the components of the locking assembly 50 is restricted. This restricts any tampering, damaging or interfering with the locking assembly 50, particularly by those individual (such as children) who may not know how to open, remove or unlock the cap 20.

Particularly, the outer wall 35 of the body portion 30 and the outer wall 25 of the cap 20 may come close, meet or be substantially flush or adjacent with one another as illustrated FIGS. 1A and 3. However, there may be a small space or gap between the lower ledge 23 of the cap and the upper ledge of the body portion in order to allow for clearance for the cap 20 to be pushed inward toward the body portion 30 in order to unlock or remove the cap 20 from the body portion 30, as described in accordance with at least one embodiment herein.

Instead, in order to remove the cap 20 from the locked engagement, the user or operator must first push the cap 20 against the biasing force of the spring or other biasing device 55 such that the locking protrusions 52 can enter the inner or intermediate grooves 64 of the locking channels 60. Only then can the cap 20 be rotated (e.g., counter-clockwise) sliding the locking protrusions 52 along the inner or intermediate groove 64 toward the opening groove 62. Once the locking notches 52 have reached the opening grooves 62 of the locking channels 60 (via an appropriate amount of twisting or rotating of the cap 20), the cap 20 can be removed from the body portion 30 by removing the locking protrusions 52 from the locking channels 60, e.g., through the opening grooves 62. In some embodiments, the spring or other biasing device 55 will assist in the removal of the locking protrusions 52 from the locking channels 60 by exerting a biasing force upon the cap 20, thereby pushing the cap 20 in an off or removal direction, e.g., by at least partially pushing the locking protrusions 52 out of the locking channels 60 through the opening grooves 62.

Figure 5:
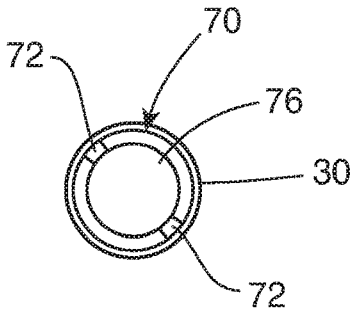
FIG. 5 is a bottom view of the writing instrument with locking cap as disclosed in accordance with at least one embodiment of the present invention.

Furthermore, with reference to the bottom view of FIG. 5, the body portion 30 of at least one embodiment includes a cooperatively structured recess 70 disposed at the bottom end 14 thereon. The recess 70 is adapted to receive a portion of the cap 20, and in particular the collar 26 and locking protrusion(s) 52 thereon in a manner such that the cap 20 can be engaged to the bottom end 14 of the body portion 30, for example, while the writing instrument is in use.

Specifically, in at least one embodiment, the recess 70 includes an annular or other like cooperating groove 76 structured to receive the collar 26 of the cap 20, with one or more notches 72 extending therefrom adapted to receive the locking protrusion(s) 52. In this manner, with the writing instrument 10 open, the cap 20 can be pushed into the bottom end 14 of the body portion 30 where the cap 20 can be retained. In some embodiments, the recess 70 at the bottom end 14 of the body portion 30 may include an inward groove where the cap 20 is simply pushed into. Other embodiments may include inner, lateral grooves (not shown) with locking notches (not shown) and/or a spring (not shown), similar to the locking grooves 60 disclosed herein. Yet additional embodiments of the recess 70 may include inner, lateral grooves and/or locking notched such that the cap can be pushed in and twisted, but without the inclusion of the biasing spring.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention. This written description provides an illustrative explanation and/or account of the present invention. It may be possible to deliver equivalent benefits using variations of the specific embodiments, without departing from the inventive concept. This description and these drawings, therefore, are to be regarded as illustrative and not restrictive.

Now that the invention has been described.

What is claimed is:

1. A writing instrument, comprising:

a body portion and a cap, said body portion comprising a writing end and a bottom end disposed longitudinally opposite from said writing end, said cap being selectively positionable between a locked engagement with, and a removed relation from, said body portion, wherein said cap comprises a main cap portion and a collar, a locking assembly adapted to lockingly engage said cap to said body portion, said locking assembly comprising at least two locking protrusions extending from said collar of said cap, and at least two cooperatively structured locking channels disposed on said body portion, wherein each of said at least two locking channels are adapted to receive a different one of said at least two locking protrusions therein to dispose said cap in said locked engagement with said body portion, wherein each of said at least two locking channels comprises an opening groove structured to receive a different one of said at least two locking protrusion therein, an inner groove and a locking notch disposed at a closed end of said locking channels, and said locking assembly further comprising a biasing device adapted to biasingly engage a portion of said cap when said cap is disposed in said locked engagement with said body portion, wherein said biasing device is adapted to bias said cap in a position wherein each of said at least two locking protrusions is disposed within said locking notch of a different one of said at least two locking channels.

2. The writing instrument as recited in claim 1 wherein physical access to said locking assembly is restricted from a position external to said writing instrument when said cap is disposed in said locked engagement with said body portion.

3. The writing instrument as recited in claim 2 wherein said body portion comprises an outer wall and an inner locking wall, said inner locking wall being structured to define said at least two locking channels thereon.

4. The writing instrument as recited in claim 3 wherein said outer wall of said body is disposed in an at least partially outer covering relation to said inner locking wall and said at least two locking channels.

5. The writing instrument as recited in claim 4 wherein said collar extends at least partially beyond a ledge of said main portion of said cap, wherein said collar is at least partially disposed within said inner locking wall of said body portion to engage said biasing device.

6. A writing instrument, comprising:

a body portion and a cap, said body portion comprising a writing end and a bottom end disposed longitudinally opposite from said writing end, said cap being selectively positionable between a locked engagement with, and a removed relation from, said writing end of said body portion, a writing cartridge disposed at least partially within said body portion of said writing instrument, said writing cartridge comprising a writing tip extending at least partially beyond said writing end of said body portion, said cap comprising a cap channel adapted to at least partially receive said writing tip of said writing cartridge when said cap is positioned in said locked engagement with said body portion of said writing instrument, a locking assembly adapted to dispose said cap in said locked engagement with said body portion, said locking assembly comprising at least two locking protrusions disposed on a collar portion of said cap, and at least two cooperatively structured locking channels disposed on an inner wall of said body portion, said at least two locking protrusions adapted to fit within said at least two locking channels to dispose said cap in said locked engagement with said body portion, each of said at least two locking channels comprise an opening groove, an intermediate groove and a locking notch disposed at a closed end, wherein said at least two locking protrusions are disposable through said opening grooves, along said intermediate grooves via rotational movement of said cap relative to said body portion and into said locking notches, and wherein said locking assembly further comprises a biasing device disposed within a biasing retention portion, said biasing device being structured to engage and bias said cap when said cap is disposed in said locked engagement with said body portion, wherein said locking protrusions are biased within said locking notches.

7. The writing instrument as recited in claim 6 wherein physical access to said locking assembly is restricted from a position external to said writing instrument when said cap is disposed in said locked engagement with said body portion.

8. The writing instrument as recited in claim 7 wherein said body portion comprises an outer wall disposed in an outer covering relation to said inner wall of said body portion, wherein said collar of said cap is positionable at least partially within said inner wall of said body portion to dispose said locking protrusions within said locking channels.

* * * * *